US005673558A

United States Patent [19]

Sugiyama et al.

[11] Patent Number: 5,673,558

[45] Date of Patent: Oct. 7, 1997

[54] HYDRAULIC CIRCUIT SYSTEM FOR HYDRAULIC EXCAVATOR

[75] Inventors: Genroku Sugiyama, Ibaraki-ken; Toichi Hirata, Ushiku; Koji Ishikawa, Tsuchiura; Tsukasa Toyooka; Tsuyoshi Nakamura, both of Ibaraki-ken, all of Japan

[73] Assignee: Hitachi Construction Machinery Co., Ltd., Tokyo, Japan

[21] Appl. No.: 596,296

[22] PCT Filed: Jun. 23, 1995

[86] PCT No.: PCT/JP95/01258

§ 371 Date: Feb. 13, 1996

§ 102(e) Date: Feb. 13, 1996

[87] PCT Pub. No.: WO96/00820

PCT Pub. Date: Jan. 11, 1996

[30] Foreign Application Priority Data

Jun. 28, 1994 [JP] Japan ..... 6-146471

[51] Int. Cl.[6] ..... F16D 31/02

[52] U.S. Cl. ..... 60/426; 60/428; 91/388; 91/403; 91/448

[58] Field of Search ..... 60/421, 426, 422, 60/428; 91/358 R, 392, 403, 511, 364, 388, 444, 448

[56] References Cited

U.S. PATENT DOCUMENTS

| | | | |
|---|---|---|---|
| 3,792,640 | 2/1974 | Shore | 91/388 X |
| 3,963,127 | 6/1976 | Eriksson | 91/388 X |
| 4,528,892 | 7/1985 | Okabe et al. . | |
| 4,561,824 | 12/1985 | Okabe et al. . | |
| 4,637,474 | 1/1987 | Leonard | 91/388 X |
| 4,884,402 | 12/1989 | Strenzke et al. | 91/364 X |
| 5,189,940 | 3/1993 | Hosseini et al. | 91/403 X |
| 5,428,958 | 7/1995 | Stenlund | 60/427 X |

FOREIGN PATENT DOCUMENTS

| | | |
|---|---|---|
| 0 059 471 | 5/1986 | European Pat. Off. . |
| 0 087 748 | 6/1986 | European Pat. Off. . |
| 58-146630 | 9/1983 | Japan . |
| 58-146632 | 9/1983 | Japan . |
| 8700505 | 3/1987 | Rep. of Korea . |

*Primary Examiner*—Hoang Nguyen

*Attorney, Agent, or Firm*—Fay, Sharpe, Beall, Fagan, Minnich & McKee

[57] ABSTRACT

For enabling a boom to be smoothly raised during the triple combined operation of boom-up, arm-crowd and bucket-crowd in a hydraulic circuit system for a hydraulic excavator, in a first valve group of a hydraulic valve apparatus (12), a variable throttle valve (70) is installed in a feeder passage (32) of a bucket directional control valve (21) downstream of a load check valve (32*a*), and a secondary pressure C as a boom-up operation command is introduced through a line (71) to a pilot control sector (70*a*) of the variable throttle valve (70) which sector operates in the throttling direction, so that when the secondary pressure C is 0 or small, the variable throttle valve (70) is fully opened and, as the secondary pressure C increases, an opening area of the variable throttle valve (70) is reduced to restrict the flow rate of a hydraulic fluid supplied through the bucket directional control valve (21).

10 Claims, 11 Drawing Sheets

HYDRAULIC CIRCUIT SYSTEM FOR HYDRAULIC EXCAVATOR

TECHNICAL FIELD

The present invention relates to a hydraulic circuit system for a hydraulic excavator, and more particularly to a hydraulic circuit system for a hydraulic excavator by which motions of three working elements, i.e., a boom, an arm and a bucket, in the combined operation thereof are improved.

BACKGROUND ART

JP.A. 58-146632 describes one known hydraulic circuit system which is mounted on a hydraulic excavator having at least three kinds of working elements, i.e., a boom, an arm and a bucket, and comprises a plurality of actuators including a boom cylinder for driving the boom, an arm cylinder for driving the arm and a bucket cylinder for driving the bucket. This known hydraulic circuit system also comprises at least two first and second hydraulic pumps, and a hydraulic valve apparatus for supplying hydraulic fluids from the first and second hydraulic pumps to at least the boom cylinder, the arm cylinder and the bucket cylinder therethrough. The hydraulic valve apparatus comprises a first boom directional control valve for controlling a flow of the hydraulic fluid supplied from the first hydraulic pump to the boom cylinder, a bucket directional control valve for controlling a flow of the hydraulic fluid supplied from the first hydraulic pump to the bucket cylinder, a second boom directional control valve for controlling a flow of the hydraulic fluid supplied from the second hydraulic pump to the boom cylinder, and an arm directional control valve for controlling a flow of the hydraulic fluid supplied from the second hydraulic pump to the arm cylinder, a first parallel passage for connecting feeder passages of the first boom directional control valve and the bucket directional control valve in parallel with respect to the first hydraulic pump so that the hydraulic fluid from the first hydraulic pump is supplied to these directional control valves in parallel, and a second parallel passage for connecting feeder passages of the second boom directional control valve and the arm directional control valve in parallel with respect to the second hydraulic pump so that the hydraulic fluid from the second hydraulic pump is supplied to these directional control valves in parallel.

DISCLOSURE OF THE INVENTION

In the prior art hydraulic circuit apparatus described above, the boom, the arm and the bucket can simultaneously be operated in various modes with the arrangement that the boom cylinder, the arm cylinder and the bucket cylinder are connected to the two hydraulic pumps through the directional control valves and the first and second parallel passages as explained above. For example, in the double combined operation of the boom and the arm, the hydraulic fluid from at least the first hydraulic pump is supplied to the boom cylinder through the first boom directional control valve, and the hydraulic fluid from the second hydraulic pump is supplied to the arm cylinder through the arm directional control valve, enabling the boom and the arm to be moved at the same time. In the double combined operation of the boom and the bucket, the hydraulic fluid from at least the second hydraulic pump is supplied to the boom cylinder through the second boom directional control valve, and the hydraulic fluid from the first hydraulic pump is supplied to the bucket cylinder through the bucket directional control valve, enabling the boom and the bucket to be moved at the same time. In the double combined operation of the bucket and the arm, the hydraulic fluid from the first hydraulic pump is supplied to the bucket cylinder through the bucket directional control valve, and the hydraulic fluid from the second hydraulic pump is supplied to the arm cylinder through the arm directional control valve, enabling the bucket and the arm to be moved at the same time. Further, in the triple combined operation of the boom, the arm and the bucket, when load pressures of the arm cylinder and the bucket cylinder are sufficiently high as developed during digging work, parts of the hydraulic fluids from the first and second hydraulic pumps are supplied to the bucket cylinder and the arm cylinder through the respective directional control valves, and the remaining parts of the hydraulic fluids from the first and second hydraulic pumps are supplied to the boom cylinder through the first and second directional control valves, enabling the boom, the arm and the bucket to be moved at the same time.

It has however been found that, in the above-stated prior art, when the boom, the arm and the bucket are simultaneously driven as the triple combined operation of boom-up, arm-crowd and bucket-crowd in the air, the boom cannot be raised as per the intention of the operator, operability of the excavator is remarkably deteriorated, and an abrupt motion contrary to the intention of the operator may possibly occur.

More specifically, in the triple combined operation of boom-up, arm-crowd and bucket-crowd, because the first boom directional control valve and the bucket directional control valve are connected in parallel with respect to the first hydraulic pump through the parallel passage, the hydraulic fluid from the first hydraulic pump is not supplied to the boom cylinder which undergoes a higher load pressure than the bucket cylinder holding the bucket which is now going to drop by its own weight. Also, because the second boom directional control valve and the arm directional control valve are connected in parallel with respect to the second hydraulic pump through the parallel passage, the hydraulic fluid from the second hydraulic pump is not supplied to the boom cylinder which undergoes a higher load pressure than the arm cylinder holding the arm which is now going to drop by its own weight. Thus, the boom is unable to rise in the triple combined operation. Therefore, the operator cannot move the boom as per the intention. For example, when the bucket cylinder moves to its stroke end with the bucket-crowd operation, the hydraulic fluid from the first hydraulic pump is abruptly supplied to the boom cylinder at this time. This may cause an abrupt motion contrary to the intention of the operator as the boom abruptly starts to rise.

An object of the present invention is to provide a hydraulic circuit system for a hydraulic excavator which can operate a boom to rise in the triple combined operation of boom-up, arm-crowd and bucket-crowd.

To achieve the above object, the hydraulic circuit system for a hydraulic excavator according to the present invention is constructed as follows. In a hydraulic circuit system mounted on a hydraulic excavator having at least three kinds of working elements of a boom, an arm and a bucket, and comprising a plurality of actuators including a boom cylinder for driving the boom, an arm cylinder for driving the arm and a bucket cylinder for driving the bucket, the hydraulic circuit system further comprising at least two first and second hydraulic pumps, and a hydraulic valve apparatus for supplying hydraulic fluids from the first and second hydraulic pumps to at least the boom cylinder, the arm cylinder and the bucket cylinder therethrough, the hydraulic valve apparatus comprising a first boom directional control valve for controlling a flow of the hydraulic fluid supplied from the first hydraulic pump to the boom cylinder, a bucket directional control valve for controlling a flow of the hydraulic fluid supplied from the first hydraulic pump to the bucket cylinder, a second boom directional control valve for controlling a flow of the hydraulic fluid supplied from the second hydraulic pump to the boom cylinder, and an arm directional control valve for controlling a flow of the hydraulic fluid supplied from the second hydraulic pump to the arm cylinder, the first boom directional control valve and the bucket directional control valve having feeder passages connected to the first hydraulic pump so that the hydraulic fluid from the first hydraulic pump is supplied in parallel to the first boom directional control valve and the bucket directional control valve, the second boom directional control valve and the arm directional control valve having feeder passages connected to the second hydraulic pump so that the hydraulic fluid from the second hydraulic pump is supplied in parallel to the second boom directional control valve and the arm directional control valve, the hydraulic circuit system for the hydraulic excavator further comprises boom-up detecting means for detecting the boom-up operation of moving the boom upwardly, and auxiliary flow control means disposed in the feeder passage of the bucket directional control valve for restricting the flow rate of the hydraulic fluid supplied through the bucket directional control valve when the boom-up operation is detected by the boom-up detecting means.

In the above hydraulic circuit system, preferably, the boom-up detecting means is means for detecting an input amount to the first boom directional control valve, and the auxiliary flow control means includes variable flow control means having an opening area reduced depending on the detected input amount.

Also, preferably, the directional control valves are pilot-operated valves shifted with hydraulic signals, and the boom-up detecting means is line means for introducing a boom-up hydraulic signal to the auxiliary flow control means therethrough.

The above hydraulic circuit system, preferably, further comprises arm-crowd detecting means for detecting the arm-crowd operation of crowding the arm inwardly, and changeover means permitting, only when the arm-crowd operation is detected by the arm-crowd detecting means, restriction of the supplied flow rate that is to be effected by the auxiliary flow control means when the boom-up operation is detected by the boom-up detecting means.

In that case, preferably, the arm-crowd detecting means is means for detecting an input amount to the arm directional control valve, and the changeover means operates to permit, only when the input amount to the arm directional control valve exceeds a predetermined value, restriction of the supplied flow rate that is to be effected by the auxiliary flow control means when the boom-up operation is detected by the boom-up detecting means.

Also, preferably, the directional control valves are pilot-operated valves shifted with hydraulic signals, the boom-up detecting means is first line means for introducing a boom-up hydraulic signal to the auxiliary flow control means therethrough, the arm-crowd detecting means is second line means for introducing an arm-crowd hydraulic signal to the changeover means therethrough, and the changeover means is a changeover valve disposed in the first line means and operated with the arm-crowd hydraulic signal through the second line means.

Further, preferably, the auxiliary flow control means comprises (a) a seat valve disposed in the feeder passage, the seat valve including a seat valve body forming an auxiliary variable throttle in the feeder passage, and a control variable throttle formed in the seat valve body and having an opening area changed depending on the amount of movement of the seat valve body; (b) a pilot line for communicating part of the feeder passage upstream of the auxiliary variable throttle with the downstream side of the feeder passage through the control variable throttle and determining the amount of movement of the seat valve body in accordance with the flow rate of the hydraulic fluid flowing therethrough; and (c) pilot flow control means including a pilot variable throttle disposed in the pilot line and changing an opening area of the pilot variable throttle in accordance with a signal from the boom-up detecting means, thereby controlling the flow rate of the hydraulic fluid flowing through the pilot line.

In that case, preferably, the auxiliary flow control means further comprises a check valve disposed in the pilot line to prevent the hydraulic fluid from flowing in the reversed direction.

In the hydraulic circuit system of the present invention constructed as set forth above, when the triple combined operation of boom-up, arm-crowd and bucket-crowd is carried out, the hydraulic fluid from the second hydraulic pump is not supplied to the boom cylinder which undergoes a higher load pressure than the arm cylinder holding the bucket which is now going to drop by its own weight. But because the boom-up detecting means detects the boom-up operation and the auxiliary flow control means restricts the flow rate of the hydraulic fluid supplied to the bucket directional control valve, the delivery pressure of the first hydraulic pump is increased so as to be higher than the load pressure of the boom and the hydraulic fluid from the first hydraulic pump is supplied to the boom cylinder which undergoes a higher load pressure than the bucket cylinder holding the bucket which is now going to drop by its own weight. Therefore, the boom can be raised in the triple combined operation of boom-up, arm-crowd and bucket-crowd, allowing the operator to manipulate the boom as per the intention, and an abrupt motion of the boom which may occur, for example, when the bucket cylinder is moved to its stroke end, can be avoided. Additionally, in the sole operation of the bucket, the auxiliary flow control means does not restrict the flow rate of the hydraulic fluid supplied through the bucket directional control valve and hence will not cause any useless throttling loss.

With the arrangement that the boom-up detecting means detects the input amount to the first boom directional control valve and the variable flow control means having an opening area reduced depending on the detected input amount is provided as the auxiliary flow control means, the flow rate of the hydraulic fluid supplied through the bucket directional control valve is restricted depending on the boom-up input amount. Accordingly, the delivery pressure of the first hydraulic pump is increased depending on the boom-up input amount, allowing the hydraulic fluid to be supplied to the boom cylinder at the flow rate depending on the boom-up input amount. Therefore, the boom-up speed can also be controlled depending on the boom-up input amount and the boom-up operation can more smoothly be performed in the triple combined operation of boom-up, arm-crowd and bucket-crowd.

When the directional control valves are pilot-operated valves shifted with hydraulic signals, the above-explained operation can be realized with a simple structure, by constructing the boom-up detecting means as line means for introducing a boom-up hydraulic signal to the auxiliary flow control means therethrough.

With the arrangement that the arm-crowd detecting means detects the arm-crowd operation of crowding the arm inwardly and the changeover means permits, only when the arm-crowd operation is detected by the arm-crowd detecting means, restriction of the supplied flow rate that is to be effected by the auxiliary flow control means when the boom-up operation is detected by the boom-up detecting means, in the double combined operation of boom-up and bucket-crowd, the hydraulic fluid from the first hydraulic pump is supplied to the boom cylinder and the bucket cylinder through the first boom directional control valve and the bucket directional control valve, respectively, and the hydraulic fluid from the second hydraulic pump is supplied to the boom cylinder through the second boom directional control valve, so that the boom cylinder is always operated. Furthermore, since the auxiliary flow control means does not restrict the flow rate of the hydraulic fluid supplied through the bucket directional control valve, no useless throttling loss is produced and the bucket speed will not be lowered.

With the arrangement that the arm-crowd detecting means detects an input amount to the arm directional control valve and, only when the detected input amount exceeds a predetermined value, it is permitted to implement restriction of the supplied flow rate that is to be effected by the auxiliary flow control means when the boom-up operation is detected by the boom-up detecting means, when the arm-crowd input amount is small in the triple combined operation of boom-up, arm-crowd and bucket-crowd and part of the hydraulic fluid from the second hydraulic pump is not supplied to the boom cylinder through the second boom directional control valve, the restriction of the supplied flow rate by the auxiliary flow control means is not effected. As a result, no useless throttling loss is produced and the bucket speed will not be lowered.

When the directional control valves are pilot-operated valves shifted with hydraulic signals, the above-explained operation can be realized with a simple structure, by modifying the arrangement such that the boom-up detecting means is first line means for introducing a boom-up hydraulic signal to the auxiliary flow control means therethrough, the arm-crowd detecting means is second line means for introducing an arm-crowd hydraulic signal to the changeover means therethrough, and the changeover means is a changeover valve disposed in the first line means and operated with the arm-crowd hydraulic signal through the second line means.

By constructing auxiliary flow control means as a flow control valve of seat valve type comprising a seat valve, a pilot line and pilot flow control means, a seat valve body of the seat valve has the structural arrangement similar to that of a load check valve disposed in a feeder passage in the conventional valve structure, and the pilot flow control means can be arranged by utilizing a fixed block which is separate from a conventional valve housing and serves to hold the seat valve body. Therefore, the auxiliary flow control means can be achieved with desired performance without modifying the structure of a conventional directional control valve to a large extent.

Additionally, since the flow control valve of seat valve type implements the two functions of the auxiliary flow control means and the load check valve, and only one seat valve is disposed in the feeder passage as a main circuit, the entire valve structure becomes simpler and compacter than in the case of arranging two valves, i.e., the load check valve and the auxiliary flow control means, in the feeder passage, and the pressure loss caused upon the hydraulic fluid passing through the main circuit is reduced so that the actuator may be operated with small energy loss.

By installing the check valve in the pilot line, it is possible to set the control variable throttle such that it is not completely closed when the seat valve body is moved to the fully closed position. With this arrangement, the pilot flow can stably be produced, the flow control accuracy is improved, and manufacture of the control variable throttle is facilitated.

BEST MODE FOR CARRYING OUT THE INVENTION

Embodiments of the present invention will hereinafter be described with reference to the drawings.

Figure 2:
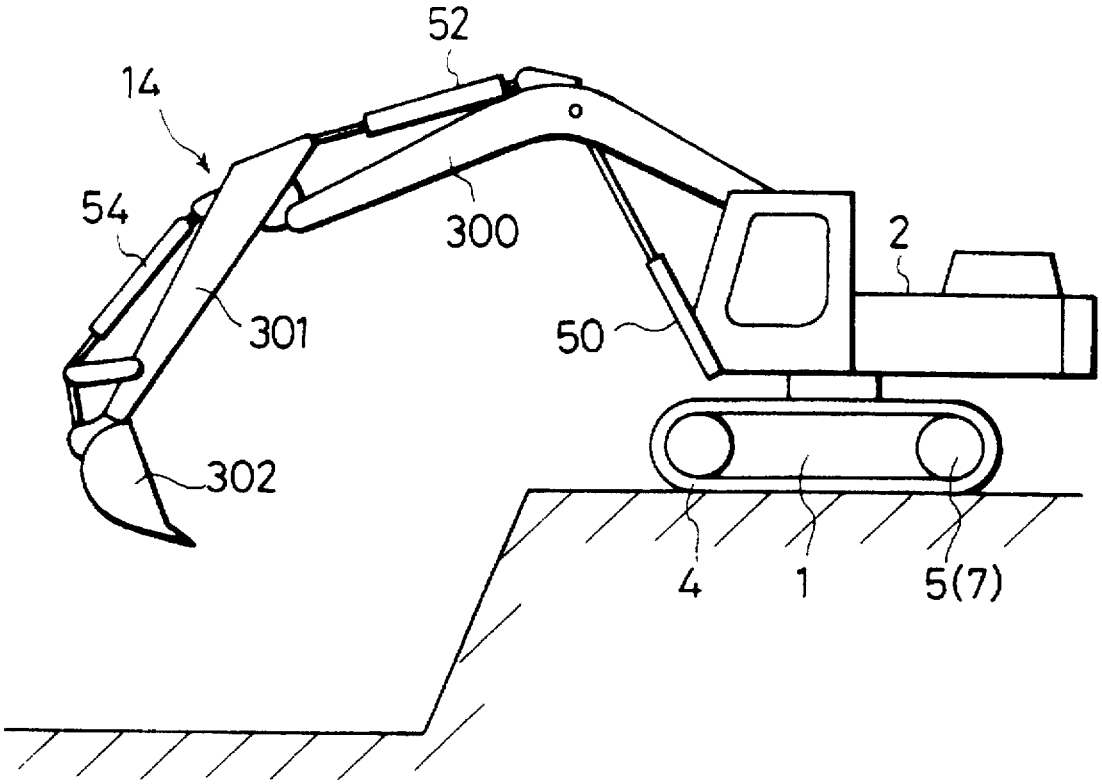
FIG. 2 is a side view of the hydraulic excavator on which the hydraulic circuit system of the present invention is mounted.
Figure 3:
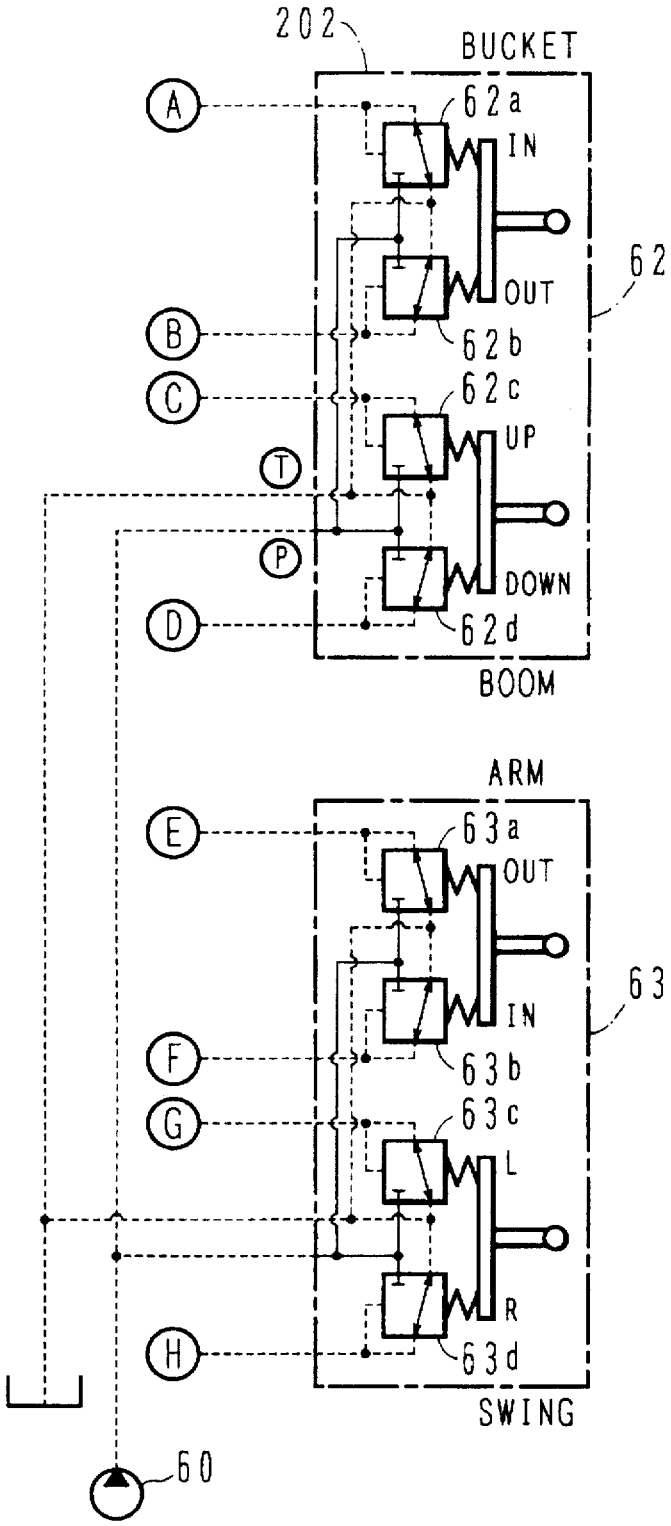
FIG. 3 is a view showing details of control lever units shown in FIG. 1.

A first embodiment of the present invention will be described with reference to FIGS. 1 to 3.

Figure 1:
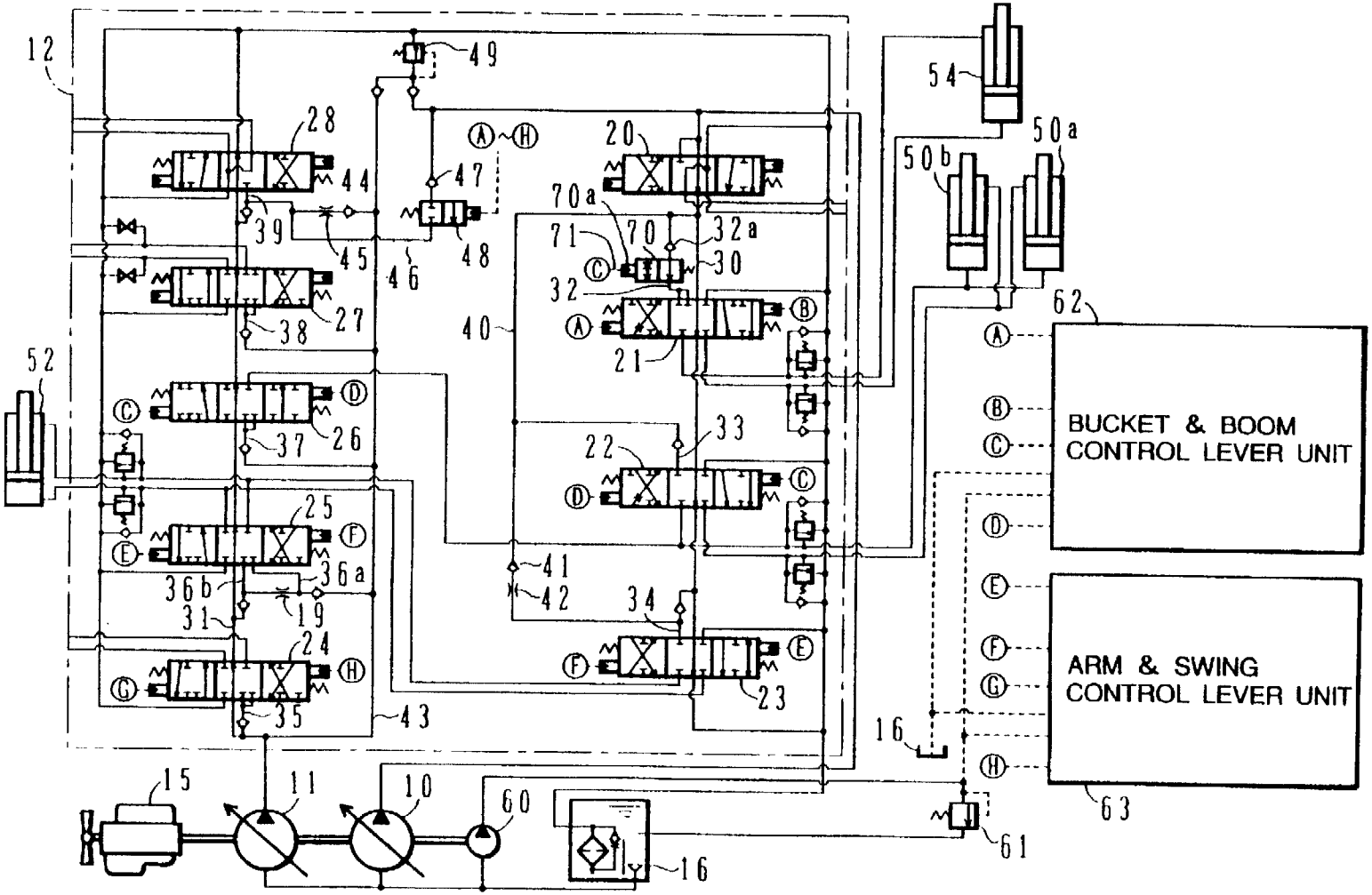
FIG. 1 is a circuit diagram of a hydraulic circuit system for a hydraulic excavator according to a first embodiment of the present invention.

In FIG. 1, a hydraulic circuit system of this embodiment is mounted on a hydraulic excavator having three kinds of working elements, i.e., a boom 300, an arm 301 and a bucket 302 shown in FIG. 2, and comprises a plurality of hydraulic actuators including boom cylinders 50*a*, 50*b* (hereinafter represented by 50) for driving the boom 301, an arm cylinder 52 for driving the arm 301, and a bucket cylinder 54 for driving the bucket 302. The boom 300, the arm 301 and the bucket 302 of the hydraulic excavator make up a front attachment 14, and the front attachment 14 is vertically movably attached so as to extend forwardly of an upper structure 2 which is swingable on an undercarriage 1. The undercarriage 1 and the upper structure 2 are driven by left and right track motors and a swing motor (all not shown), respectively. These track motors and swing motor are also included in the above-mentioned plurality of actuators.

The hydraulic circuit system of this embodiment further comprises first and second hydraulic pumps 10, 11 as main pumps. Hydraulic fluids from the first and second hydraulic pumps 10, 11 are supplied through a hydraulic valve apparatus 12 to the boom cylinder 50, the arm cylinder 52 and the bucket cylinder 54, as well as the track motors and the swing motor (not shown).

The hydraulic valve apparatus 12 includes a first track directional control valve 20, a bucket directional control valve 21, a first boom directional control valve 22 and a first arm directional control valve 23 for controlling respective flows of the hydraulic fluid supplied from the first hydraulic pump 10 to one of the left and right track motors (not shown), the bucket cylinder 54, the boom cylinder 50 and the arm cylinder 52, and a swing directional control valve 24, a second arm directional control valve 25, a second boom directional control valve 26, an auxiliary directional control valve 27 and a second track directional control valve 28 for controlling respective flows of the hydraulic fluid supplied from the second hydraulic pump 11 to the swing motor (not shown), the arm cylinder 52, the boom cylinder 50, an auxiliary actuator (not shown), and the other of the left and right track motors (not shown).

The directional control valves 20 to 28 are each of a center bypass type valve having a center bypass passage. The center bypass passages in the directional control valves 20 to 23 are connected in series to a center bypass line 30 which is in turn connected to a delivery line of the first hydraulic pump 10, thereby making up a first valve group, while the center bypass passages in the directional control valves 24 to 28 are connected in series to a center bypass line 31 which is in turn connected to a delivery line of the second hydraulic pump 11, thereby making up a second valve group.

In the first valve group, the directional control valve 20 is connected in tandem with respect to the other directional control valves 21 to 23 so that the hydraulic fluid from the first hydraulic pump 10 is supplied to the directional control valve 20 with priority over the other directional control valves 21 to 23. Feeder passages 32, 33 of the directional control valves 21, 22 are connected in parallel with respect to the first hydraulic pump 10 through a first parallel passage 40 so that the hydraulic fluid from the first hydraulic pump 10 is supplied to the directional control valves 21, 22 in parallel. Further, the directional control valve 23 is connected in tandem with respect to the other directional control valves 20 to 22 most downstream of the center bypass line 30 so that the hydraulic fluid from the first hydraulic pump 10 is supplied to the other directional control valve 20 to 22 with priority over the directional control valve 23, and its feeder passage 34 is also connected to the first parallel passage 40. The first parallel passage 40 includes a load check valve 41 allowing the hydraulic fluid to flow only in the direction toward the first arm directional control valve 23, and a fixed throttle 42 therein.

The throttle 42 functions to prevent an abrupt change in the arm speed which will otherwise be caused upon operation of the boom and the bucket because the first arm directional control valve 23 is connected in tandem to the boom directional control valve 22 and the bucket directional control valve 21. If the opening of the throttle 42 is too large, the hydraulic fluid from the first hydraulic pump 10 would mostly be supplied to the arm on the lower pressure side in the combined operation of the arm and the boom and/or the bucket. Therefore, the opening of the throttle 42 is required to be set to such a small extent that the above function is not impaired.

In the second valve group, feeder passages **36*a*, 36*b* to 38 of the directional control valves 25 to 27 are connected in parallel with respect to the second hydraulic pump 11 through a second parallel passage 43 so that the hydraulic fluid from the second hydraulic pump 11 is supplied to the directional control valves 25 to 27 in parallel. Also, the directional control valve 24 is connected in parallel to the feeder passage 36*a* of the directional control valve 25 and the directional control valves 26, 27 through the parallel passage 43, while it is connected in tandem to the feeder passage 36*b* of the directional control valve 25 so that the hydraulic fluid from the second hydraulic pump 11 is supplied to the directional control valve 24 with priority. The feeder passage 36*b* of the directional control valve 25 is also connected to the second parallel passage 43 through a fixed throttle 19. Furthermore, the directional control valve 28 is connected in tandem with respect to the other directional control valves 24 to 27 so that the hydraulic fluid from the second hydraulic pump 11 is supplied to the other directional control valves 24 to 27 with priority over the directional control valve 28, and its feeder passage 39 is also connected to the second parallel passage 43. The second parallel passage 43 includes a load check valve 44 allowing the hydraulic fluid to flow only in the direction toward the directional control valve 28, and a fixed throttle 45 therein. As with the throttle 42, the throttles 19, 45** each have a function of preventing an abrupt change in the actuator speed which will otherwise be caused upon operation of the actuator associated with the upstream directional control valve.

In addition, the feeder passage 39 of the second track directional control valve 28 is further connected to the first hydraulic pump 10 through a communication line 46. A check valve 47 for allowing the hydraulic fluid to flow only in the direction toward the second track directional control valve 28 and a switching valve 48 are installed in the communication line 46. A common relief valve 49 is installed in the upstream side of the center bypass line 30 and in the downstream side of the second parallel passage 43 for restricting an upper limit of the delivery pressures of the first and second hydraulic pumps 10, 11.

The hydraulic circuit system of this embodiment further comprises a pilot pump 60 of which delivery pressure is adjusted to a pilot pressure determined by a pilot relief valve 61. As shown in FIG. 3, the pilot pressure is supplied as a pilot valve primary pressure pilot valves **62*a*, 62*b*; 62*c*, 62*d* of a bucket and boom control lever unit 62, 63*a*, 63*b*; 63*c*, 63*d* of an arm and swing control lever unit 63, and pilot valves of a track control lever unit (not shown). Secondary pressures delivered from the pilot valves act, as hydraulic signals for operating associated actuators, on the directional control valves 20 to 26 and 28 for shifting them. In FIG. 3, particularly, the secondary pressure as a boom-up hydraulic signal is denoted by C, the secondary pressure as an arm-crowd hydraulic signal is denoted by F, and the secondary pressure as a bucket-crowd hydraulic signal is denoted by A, respectively. The secondary pressure C acts on the first and second boom directional control valves 22, 26, whereupon these directional control valves 22, 26 are shifted so that the hydraulic fluid from the first hydraulic pump 10 and the hydraulic fluid from the second hydraulic pump 11 are joined with each other and then supplied to the bottom side of the boom cylinder 50. The secondary pressure F acts on the first and second arm directional control valves 23, 25, whereupon these directional control valves 23, 25 are shifted so that the hydraulic fluid from the second hydraulic pump 11 and the hydraulic fluid from the first hydraulic pump 10 are joined with each other and then supplied to the bottom side of the arm cylinder 52. The secondary pressure A acts on the bucket directional control valve 21, whereupon the directional control valve 21 is shifted so that the hydraulic fluid from the first hydraulic pump 10 is supplied to the bottom side of the bucket cylinder 54**.

Further, the secondary pressures A to H also act on the switching valve 48 to make it open in the track combined operation, enabling the hydraulic fluid from the first hydraulic pump 10 to be supplied to the left and right track motors.

Figure 4:
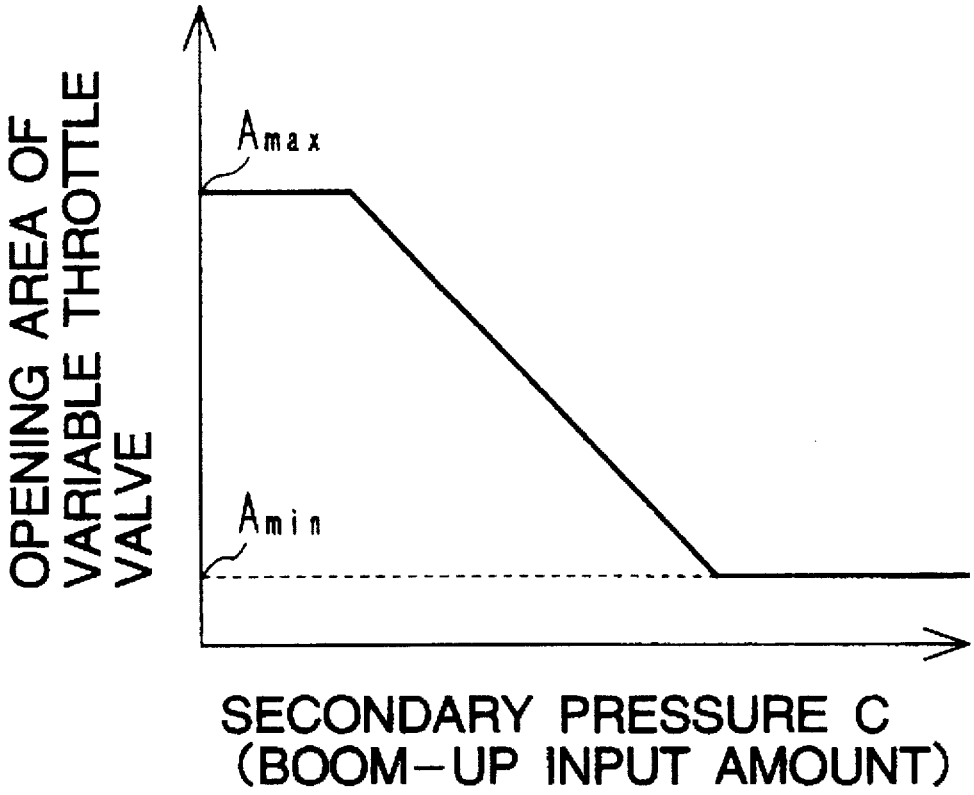
FIG. 4 is a graph showing an opening characteristic of a variable throttle valve shown in FIG. 1.

Then, in the first valve group of the hydraulic valve apparatus 12, a variable throttle valve 70 as auxiliary flow control valve constituting a feature of the present invention is installed downstream of a load check valve 32*a* in the feeder passage 32 of the bucket directional control valve 20. The variable throttle valve 70 has a pilot control sector 70*a* operable in the throttling direction, and the boom-up secondary pressure C is introduced to the pilot control sector 70*a* through a line 71. The variable throttle valve 70 has an opening characteristic set, as shown in FIG. 4, such that the variable throttle valve 70 is fully opened with a maximum opening area Amax when the secondary pressure C (boom-up input amount) is 0 or small, then the opening area of the variable throttle valve 70 is reduced as the secondary pressure C increases, and the variable throttle valve 70 has a minimum opening area Amin when the secondary pressure C is further increased.

In the above arrangement, the line 71 constitutes boom-up detecting means for detecting the boom-up operation of moving the boom 300 upwardly, and the variable throttle valve 70 constitutes auxiliary flow control means for restricting the flow rate of the hydraulic fluid supplied through the bucket directional control valve 21 when the boom-up operation is detected by the boom-up detecting means. Also, the line 71 constitutes means for detecting the input amount to the first boom directional control valve 22, and the variable throttle valve 70 constitutes variable flow control means having an opening area reduced depending on the detected input amount.

Incidentally, denoted by 15 is an engine for driving the hydraulic pump 10, 11, 60 and 16 is a reservoir.

With the hydraulic circuit system of this embodiment arranged as explained above, the boom can easily be raised, which has been difficult in the prior art, when the boom, the arm and the bucket are simultaneously driven as the triple combined operation of boom-up, arm-crowd and bucket-crowd in the air.

More specifically, when the operator manipulates the bucket and boom control lever unit 62 and the arm and swing control lever unit 63 to generate the boom-up secondary pressure C, the arm-crowd secondary pressure F, and the bucket-crowd secondary pressure A with the intention of carrying out the triple combined operation of boom-up, arm-crowd and bucket-crowd, the first and second boom directional control valves 22, 26 are shifted by the secondary pressure C, the first and second arm directional control valves 23, 25 are shifted by the secondary pressure F, and the bucket directional control valve 21 is shifted by the secondary pressure A. At this time, in the second valve group, because the second boom directional control valve 26 and the second arm directional control valve 25 are connected in parallel through the second parallel passage 43, the hydraulic fluid from the second hydraulic pump 11 is not supplied to the boom cylinder 50 which undergoes a higher load pressure than the arm cylinder 52 holding the arm 301 which is now going to drop by its own weight. In the first valve group, however, not only the first boom directional control valve 22 and the bucket directional control valve 21 are connected in parallel through the first parallel passage 40, but also the variable throttle valve 70 as the auxiliary flow control means is installed in the feeder passage 32 of the bucket directional control valve 21 so that the boom-up secondary pressure C acts on the variable throttle valve 70. Therefore, the variable throttle valve 70 restricts, depending on the secondary pressure C, the flow rate of the hydraulic fluid supplied through the bucket directional control valve 21, enabling the pressure in the first parallel passage 40 (the delivery pressure of the first hydraulic pump 10) to become higher than the load pressure of the boom 300. Hence, the hydraulic fluid from the first hydraulic pump 10 can be supplied to the boom cylinder 50 which undergoes a higher load pressure than the bucket cylinder 54 holding the bucket 302 which is now going to drop by its own weight. Also, because the variable throttle valve 70 restricts the flow rate of the hydraulic fluid supplied through the bucket directional control valve 21 while changing its opening area depending on the boom-up secondary pressure C, it is possible to increase the delivery pressure of the first hydraulic pump 10 depending on the boom-up secondary pressure C so that the hydraulic fluid may be supplied to the boom cylinder at the flow rate depending on the secondary pressure C (the boom-up input amount). Accordingly, the boom-up speed can also be increased depending on the boom-up input amount. As a result, even when the triple combined operation of boom-up, arm-crowd and bucket-crowd is carried out in the air, the boom can smoothly be raised, allowing the operator to manipulate the boom as per the intention, and a dangerous abrupt motion of the boom which may occur, for example, when the bucket cylinder is moved to its stroke end, can be avoided so as to ensure safety during the work.

Additionally, in the sole operation of the bucket, the variable throttle valve 70 as the auxiliary flow control means is kept in its full position and hence will not cause any useless throttling loss.

According to this embodiment, therefore, even when the triple combined operation of boom-up, arm-crowd and bucket-crowd is carried out in the air, the boom can smoothly be raised, allowing the operator to manipulate the boom as per the intention, and a dangerous abrupt motion of the boom which may occur, for example, when the bucket cylinder is moved to its stroke end, can be avoided so as to ensure safety during the work.

Figure 5:
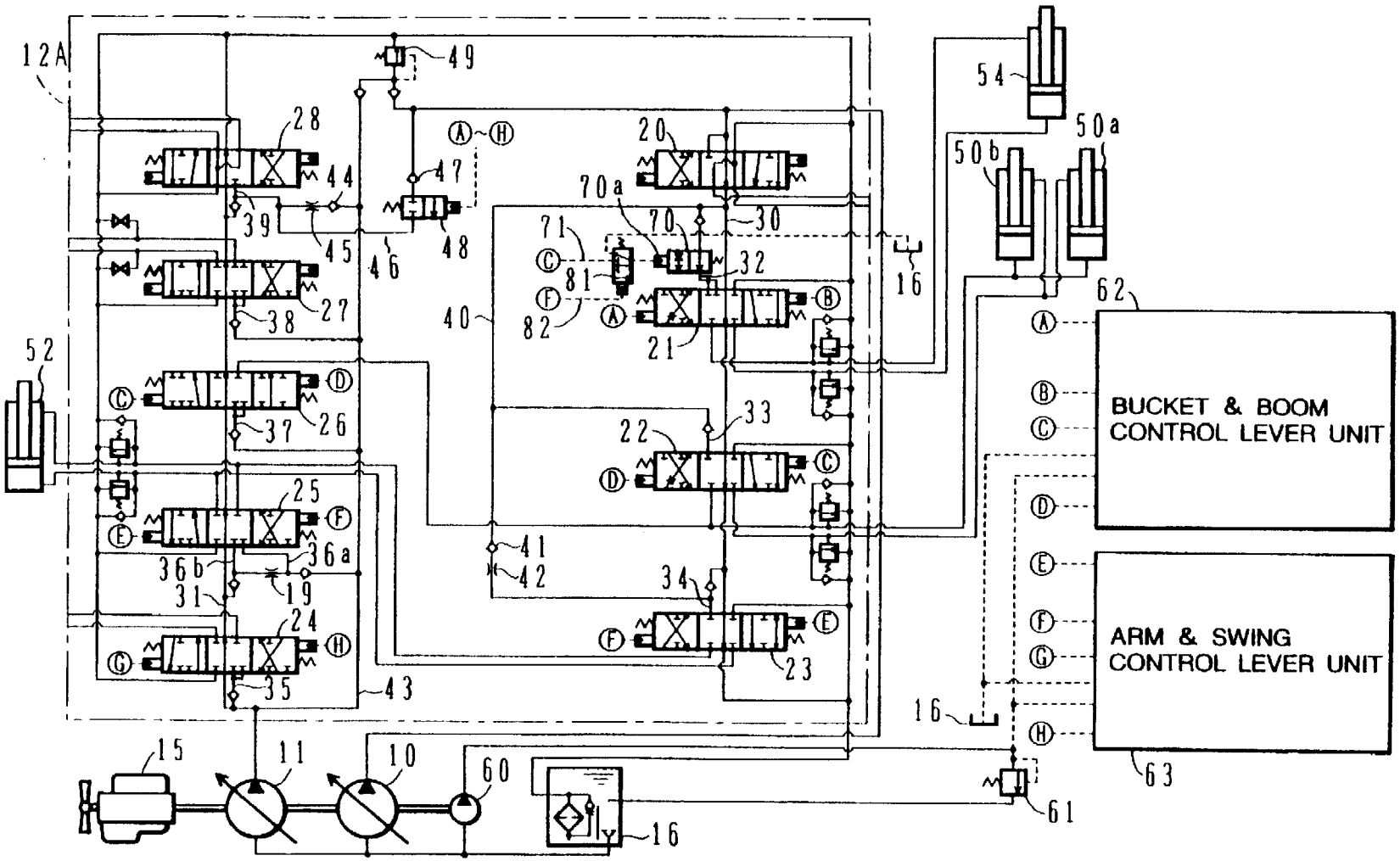
FIG. 5 is a circuit diagram of a hydraulic circuit system for a hydraulic excavator according to a second embodiment of the present invention.

A second embodiment of the present invention will be described with reference to FIGS. 5 to 7. In FIG. 5, identical members to those in FIG. 1 are denoted by the same reference numerals.

Figure 6:
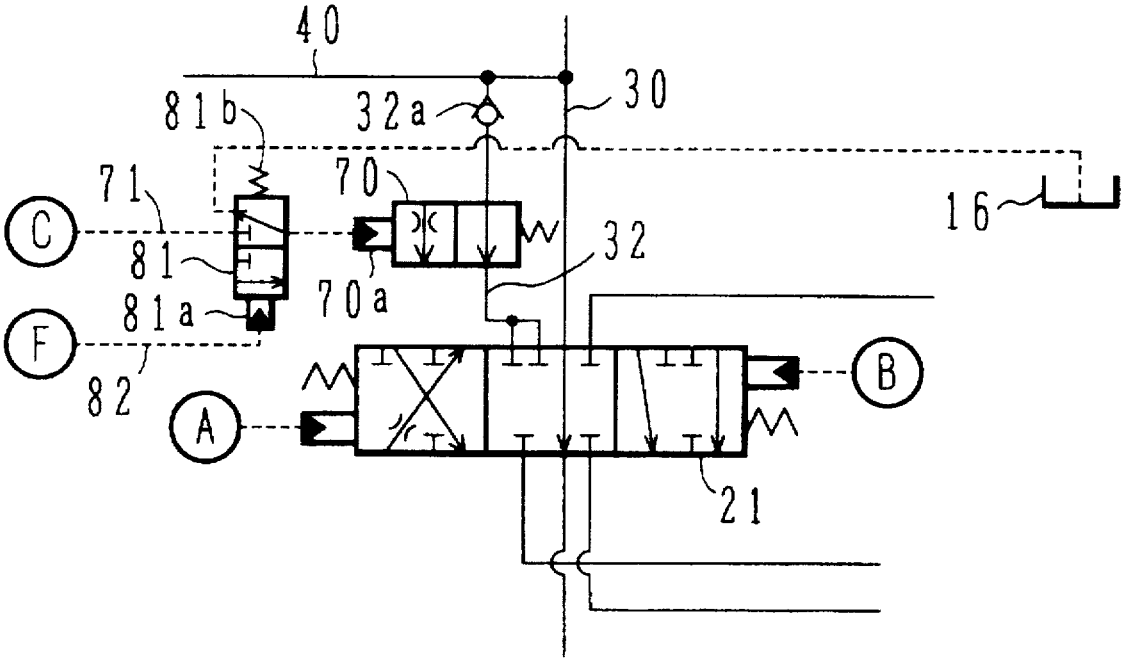
FIG. 6 is an enlarged view of a section including a variable throttle valve shown in FIG. 5.

Referring to FIGS. 5 and 6, a hydraulic valve apparatus 12A in a hydraulic circuit system of this embodiment includes, as with the first embodiment, the variable throttle valve 70 as the auxiliary flow control means installed downstream of the load check valve 32*a* in the feeder passage 32 of the bucket directional control valve 21, the boom-up secondary pressure C being introduced to the pilot control sector 70*a* of the variable throttle valve 70 through the line 71. In addition, a pilot changeover valve 81 is installed in the line 71. The pilot changeover valve 81 has a pilot control sector 81*a* operable against a spring 81*b*, and the arm-crowd secondary pressure F is introduced to the pilot control sector 81*a* through a line 82. When the secondary pressure F is lower than the set value of the spring 81*b*, the pilot changeover valve 81 is held in the illustrated position to cut off communication between the line 71 and the pilot control sector 70*a* of the variable throttle valve 70, while communicating the pilot control sector 70*a* with the reservoir 16. When the secondary pressure F becomes higher than the set value of the spring 81*b*, the pilot changeover valve 81 is shifted from the illustrated position to communicate the line 71 with the pilot control sector 70*a* of the variable throttle valve 70 so that the boom-up secondary pressure C may be introduced to the pilot control sector 70*a*.

Figure 7:
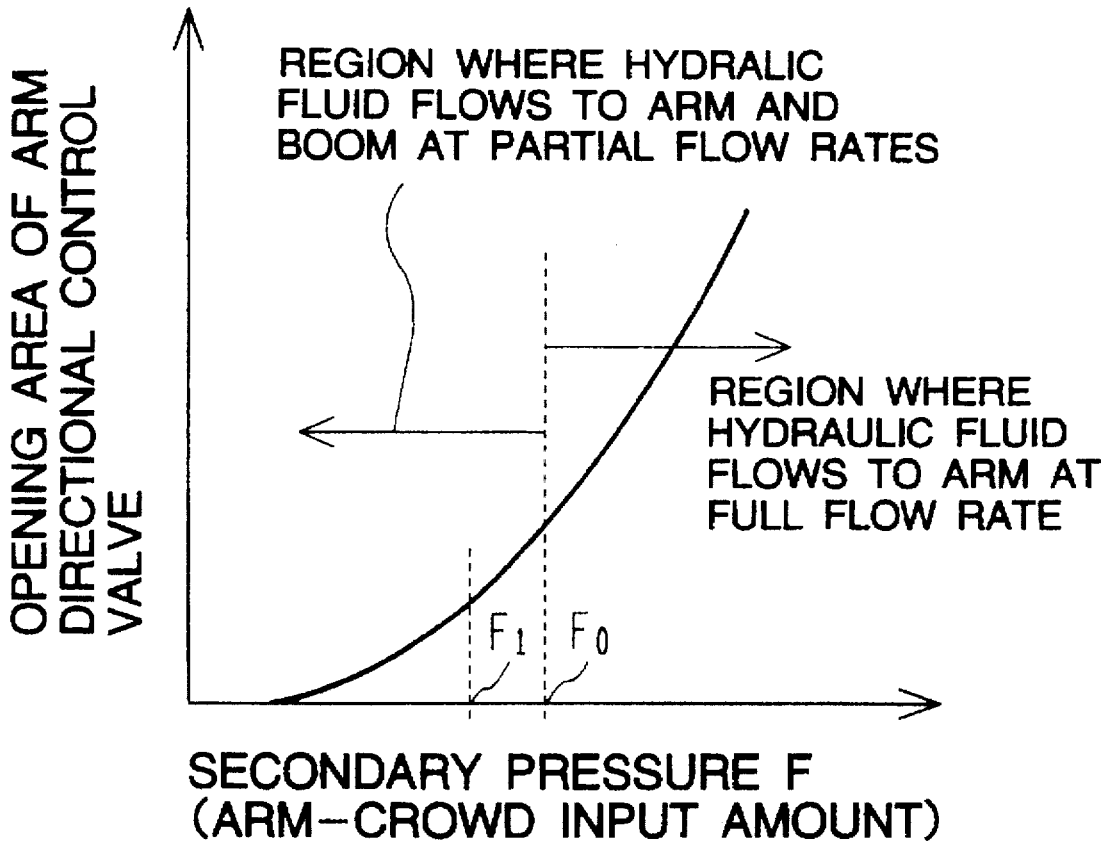
FIG. 7 is a graph showing an opening characteristic of a second arm directional control valve shown in FIG. 5.

FIG. 7 shows an opening characteristic of the second arm directional control valve 25. When the combined operation of boom-up and arm-crowd is carried out under an ordinary load condition, if the arm-crowd secondary pressure F (arm-crowd input amount) is not higher than F0, one part of the hydraulic fluid from the second hydraulic pump 11 flows to the arm cylinder 52 and the other part thereof flows to the boom cylinder 50. If the secondary pressure F becomes higher than F0, the hydraulic fluid from the second hydraulic pump 11 flows to the arm cylinder 52 at the full flow rate. The spring 81*b* of the pilot changeover valve 81 is set so that the pilot changeover valve 81 is shifted from the illustrated position when the arm-crowd secondary pressure F reaches F1 a little smaller than F0.

In the above arrangement, the line 82 constitutes arm-crowd detecting means for detecting the arm-crowd operation of crowding the arm inwardly, and the pilot changeover means 81 constitutes changeover means permitting restriction of,the supplied flow rate by the variable throttle valve 70 as the auxiliary flow control means only when the arm-crowd operation is detected by the arm-crowd detecting means. Also, the line 82 constitutes means for detecting the input amount to the second arm directional control valve 25, and the pilot changeover valve 81 operates to permit restriction of the supplied flow rate by the auxiliary flow control means only when the detected input amount exceeds a predetermined value.

With this embodiment arranged as explained above, in the case of driving the boom, the arm and the bucket simultaneously as the triple combined operation of boom-up, arm-crowd and bucket-crowd in the air, when the arm-crowd secondary pressure F exceeds the pressure F0 at or above which the hydraulic fluid from the second hydraulic pump 11 flows to the arm cylinder 52 at the full flow rate, the pilot changeover valve 81 is shifted from the illustrated position, whereupon the boom-up secondary pressure C is introduced to the pilot control sector 70*a* of the variable throttle valve 70. As with the first embodiment, therefore, the variable throttle valve 70 can restrict the flow rate of the hydraulic fluid supplied through the bucket directional control valve 21 depending on the secondary pressure C and raise the pressure in the first parallel passage 40 so as to be not less than the load pressure of the boom 300. Consequently, the hydraulic fluid from the first hydraulic pump 10 can be supplied to the boom cylinder 50 which undergoes a higher load pressure than the bucket cylinder 54 holding the bucket 302 which is now going to drop by its own weight, enabling the boom to be raised easily.

On the other hand, in the double combined operation of boom-up and bucket-crowd, the hydraulic fluid from the first hydraulic pump 10 is supplied to the boom cylinder 50 and the bucket cylinder 54 and the hydraulic fluid from the second hydraulic pump 11 is supplied to the boom cylinder 50, so that the boom cylinder 50 is always operated. Accordingly, there is no need of restricting the flow rate of the hydraulic fluid supplied through the bucket directional control valve 21. In the first embodiment, however, the variable throttle valve 70 is operated in this case as well to restrict the flow rate of the hydraulic fluid supplied through the bucket directional control valve 21. This not only causes useless throttling loss, but also raises a fear of lowing the bucket speed in the double combined operation of boom-up and bucket-crowd. By contrast, in this embodiment, since the pilot changeover valve 81 is kept in the illustrated position during the above double combined operation, the boom-up pilot secondary pressure C does not act on the variable throttle valve 70 so as to hold it at the fully open position. Therefore, neither useless throttling loss will be produced, nor the bucket speed will be reduced.

Also, in the triple combined operation of boom-up, arm-crowd and bucket-crowd, when the arm-crowd secondary pressure F is not higher than F0 and part of the hydraulic fluid from the second hydraulic pump 11 is supplied to the boom cylinder 50 through the second boom directional control valve 26, the pilot changeover valve 81 is kept in the illustrated position and the boom-up secondary pressure C is not introduced to the pilot control sector 70*a* of the variable throttle valve 70 and, therefore, the variable throttle valve 70 does not restrict the flow rate of the hydraulic fluid supplied through the bucket directional control valve 21. As a result, neither useless throttling loss will be produced, nor the bucket speed will be reduced.

Accordingly, this embodiment can provide, in addition to the advantages of the first embodiment, an advantage of improving operability and economic efficiency in the double combined operation of boom-up and bucket-crowd and in the triple combined operation of boom-up, arm-crowd and bucket-crowd.

Figure 8:
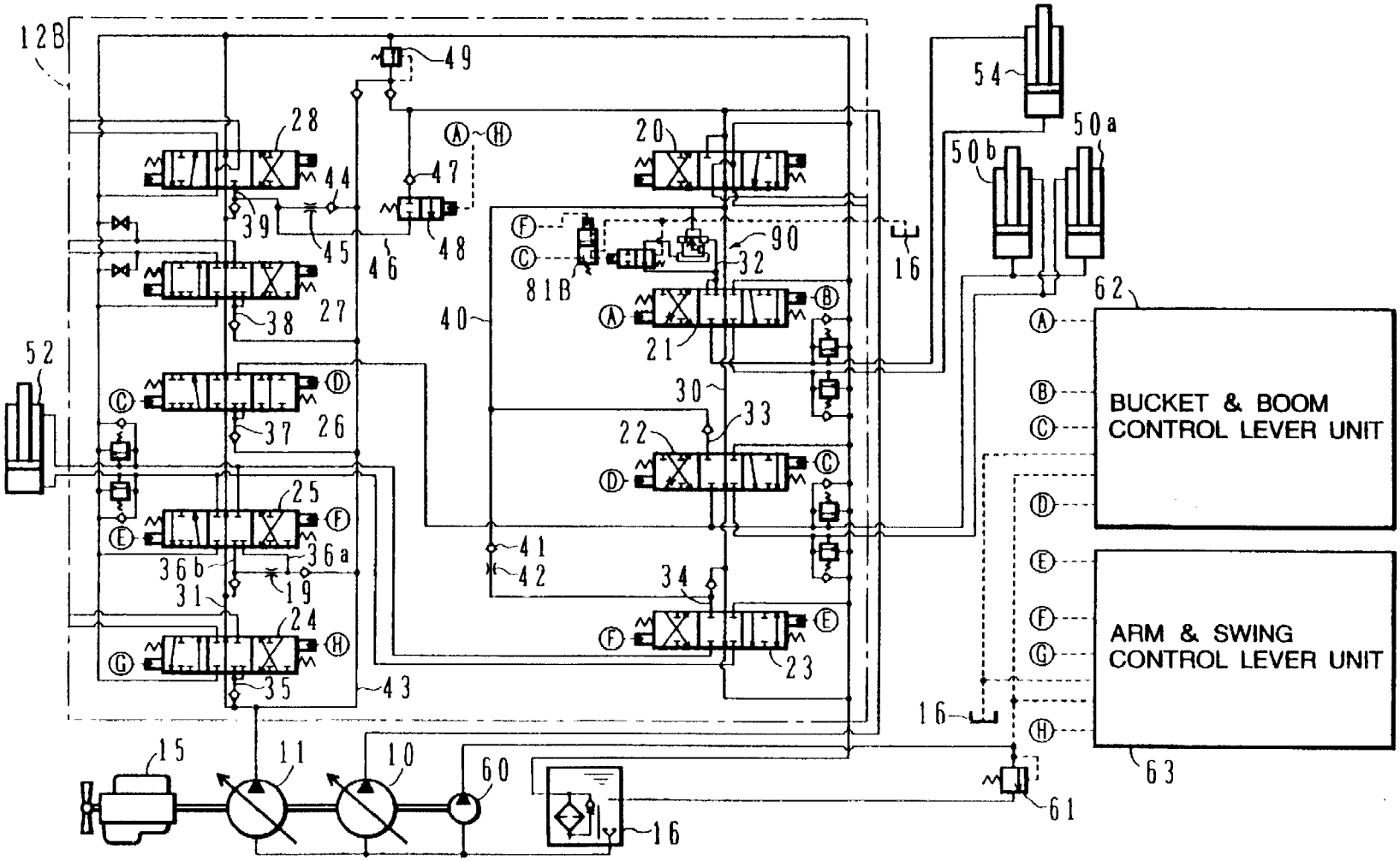
FIG. 8 is a circuit diagram of a hydraulic circuit system for a hydraulic excavator according to a third embodiment of the present invention.

A third embodiment of the present invention will be described with reference to FIGS. 8 to 11. In FIG. 8, identical members to those in FIG. 1 are denoted by the same reference numerals.

Figure 9:
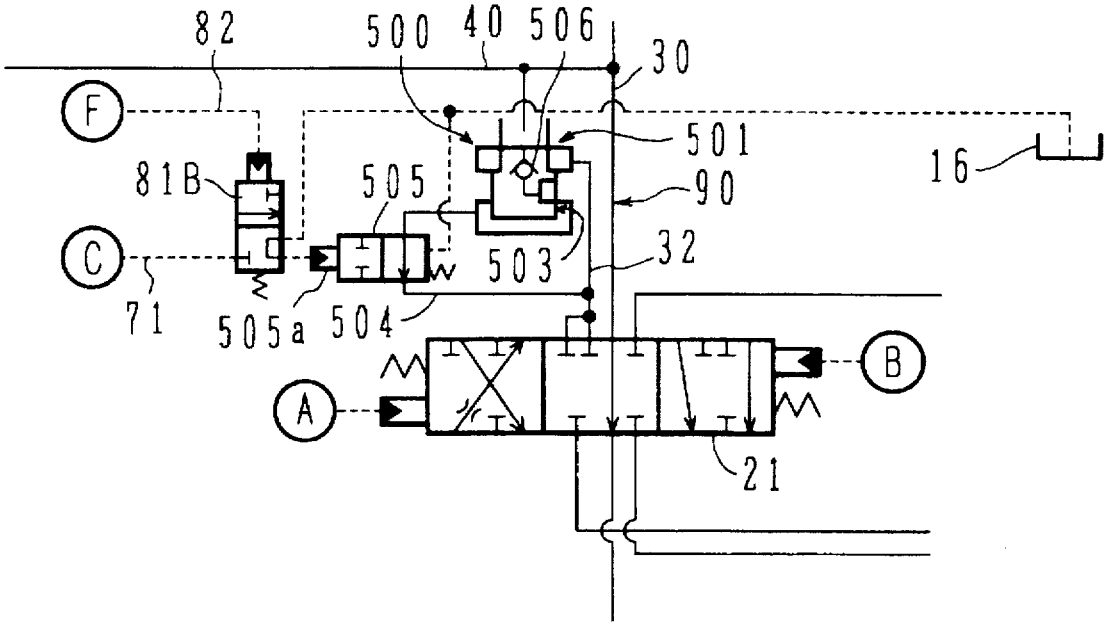
FIG. 9 is an enlarged view of a section including a flow control valve of seat valve type shown in FIG. 8.

Referring to FIGS. 8 and 9, a hydraulic valve apparatus 12B in a hydraulic circuit system of this embodiment is arranged such that a flow control valve 90 of seat valve type as the auxiliary flow control means is installed in the feeder passage 32 of the bucket directional control valve 21, the secondary pressure C as a boom-up hydraulic signal acting on the flow control valve 90 through the line 71, and a pilot changeover valve 81B is installed in the line 71, the secondary pressure F as an arm-crowd operation command acting on the pilot changeover valve 81B. The construction and function of the pilot changeover valve 81B are essentially the same as those of the pilot changeover valve 81 in the first embodiment and will not described below.

The flow control valve 90 of seat valve type comprises, as shown in FIG. 9, a seat valve 500 having a seat valve body 502 disposed in the feeder passage 32, a pilot line 504 for determining the amount of movement of the seat valve body 502, and a pilot variable throttle valve 505 disposed in the pilot line 504. The seat valve body 502 has an auxiliary variable throttle 501 and a control variable throttle 503 which are formed in the feeder passage 32 and the pilot line 504, respectively, and each of which has an opening area changed depending on the amount of movement of the seat valve body 502. The pilot line 504 communicates part of the feeder passage 32 upstream of the auxiliary variable throttle 501 with the downstream side of the feeder passage 32 through the control variable throttle 503 and determines the amount of movement of the seat valve body 502 in accordance with the flow rate of the hydraulic fluid flowing therethrough. The pilot variable throttle valve 505 has a pilot control sector 505*a* operable in the throttling direction, and the secondary pressure C as a boom-up, hydraulic signal is introduced to the pilot control sector 505*a* through the line 71. Further, a load check valve 506 is disposed in a pilot line inside the seat valve body 502.

Figure 10:
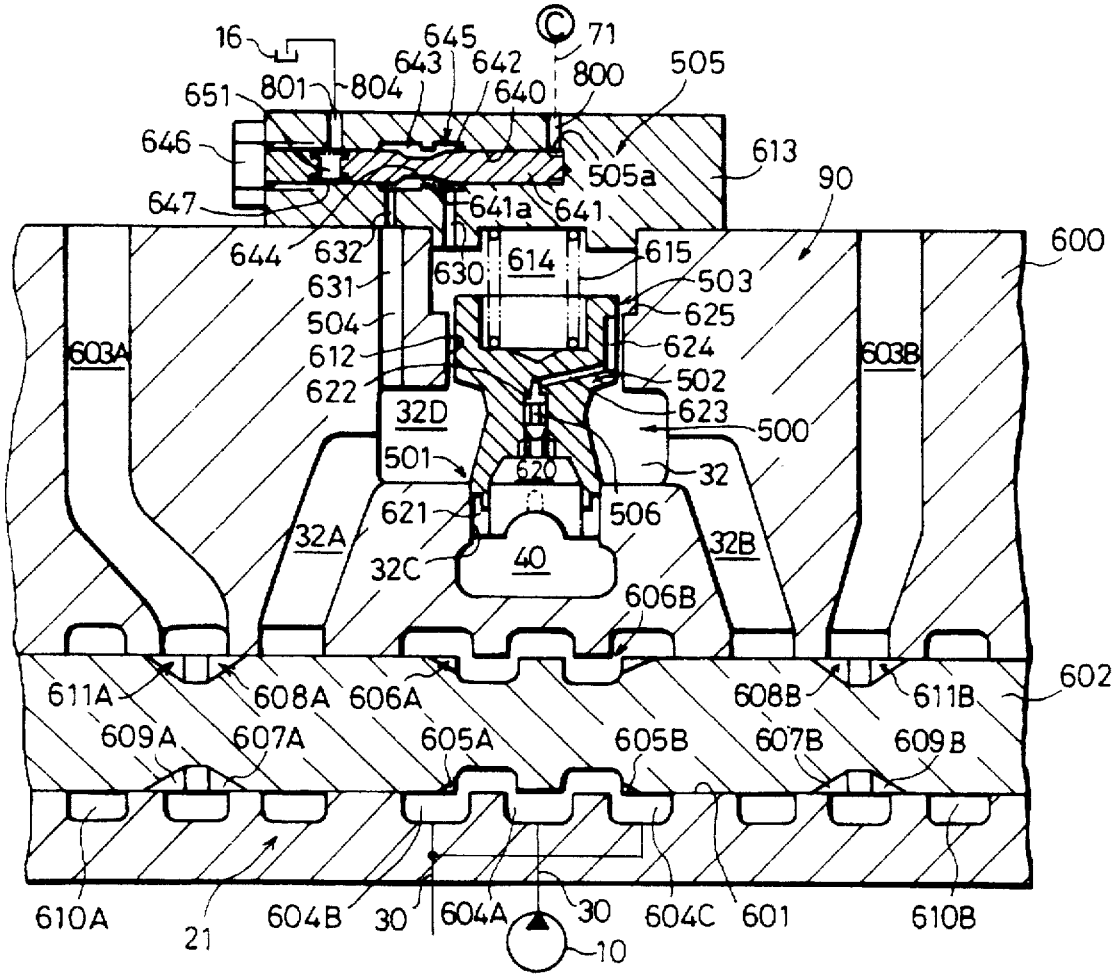
FIG. 10 is a view showing a valve structure of a bucket directional control valve and the section including the flow control valve of seat valve type shown in FIG. 8.

FIG. 10 shows a valve structure in which the flow control valve 90 of seat valve type explained above and the directional control valve 21 are incorporated together.

In FIG. 10, denoted by 600 is a housing which has a bore 601 formed therein so as to penetrate it, with a main spool 602 of the directional control valve 21 slidably inserted in the bore 601. The housing 600 also has formed therein the first parallel passage 40, load passages 603A, 603B connected to the bucket cylinder 54, and the feeder passage 32 branched from the first parallel passage 40 and being able to communicate with the load passages 603A, 603B. The feeder passage 32 consists of a passage portion 32C communicating with the first parallel passage 40, a pair of passage portions 32A, 32B positioned on both sides of the passage portion 32C, and an annular passage portion 32D communicating between the passage portion 32C and the passage portions 32A, 32B. Hereinafter, the passage portions 32A to 32D will be referred to simply as feeder passages.

Near the center of the bore 601, there are formed an annular inlet-side center bypass passage 604A and annular outlet-side center bypass passage 604B, 604C all communicating with the center bypass line 30. Notches 605A, 605B are formed in the main spool 602 to form bleed-off variable throttles 606A, 606B located between the inlet-side center bypass passage 604A and the outlet-side center bypass passage 604B, 604C, respectively, and each having an opening area changed correspondingly from a fully open position to a fully closed position depending on the amount of movement of the main spool 602 from its neutral position (i.e., spool stroke).

Also, notches 607A, 607B are formed in the main spool 602 to form meter-in main variable throttles 608A, 608B located between the feeder passages 32A, 32B and the load passages 603A, 603B, respectively, and each having an opening area changed correspondingly from a fully closed position to a predetermined maximum opening position depending on the amount of movement of the main spool 602 from its neutral position. Further, notches 609A, 609B are formed in the main spool 602 to form meter-out main variable throttles 611A, 611B located between the load passages 603A, 603B and drain passages 610A, 610B communicating with the reservoir 16 (see FIG. 8), respectively, and each having an opening area changed correspondingly from a fully closed position to a predetermined maximum opening position depending on the amount of movement of the main spool 602 from its neutral position.

The seat valve body 502 is slidably accommodated in a bore 612 also formed in the housing 600 perpendicularly to the bore 601 and an open end of the bore 612 is closed by a fixed block 613, with a hydraulic chamber 614 defined between the seat valve body 502 and the fixed block 613. A spring 615 for urging the seat valve body 502 in the valve closing direction is disposed in the hydraulic chamber 614. The spring 615 is provided to absorb vibrations and the urging force exerted by the spring 615 upon the seat valve body 502 is negligibly small.

The seat valve body 502 is shaped on the side opposite to the hydraulic chamber 614 into the tubular form having a recess 620 defined in its central portion, as shown. A plurality of semicircular notches 621 are formed so as to penetrate through a side wall of the tubular portion such that the notches 621 cooperate with a seat portion of the housing 600 to form the auxiliary variable throttle 501 between the feeder passage 32C and the feeder passage 32D. The auxiliary variable throttle 501 has an opening area changed correspondingly from a fully closed position to a predetermined maximum opening position depending on the amount of movement (i.e., stroke) of the seat valve body 502.

Further, in an outer peripheral surface of the seat valve body 502, there is formed a pilot flow groove 624 communicating with the feeder passage 32C through passages 622, 623 formed inside the seat valve body 502. The pilot flow groove 624 cooperates with a land portion 625 defined by a step of the bore 612 to form the control variable throttle 503 between the feeder passage 32C and the hydraulic chamber 614. The control variable throttle 503 is a little opened when the seat valve body 502 is in the fully closed position, and then gradually changes its opening area until a predetermined maximum opening depending on the amount of movement (i.e., stroke) of the seat valve body 502. A check valve serving as the aforementioned load check valve 506, which allows the hydraulic fluid to flow from the feeder passage 32C toward the hydraulic chamber 614, but blocks off the flow in the reversed direction, is disposed in the passage 622.

The fixed block 613 has formed therein a passage 630 communicating with the hydraulic chamber 614, and a passage. 632 communicating with the feeder passage 32D through a passage 631 formed in the housing 600. The pilot variable throttle valve 505 is disposed between the passage 630 and the passage 632. The passages 622, 623, the hydraulic chamber 614, the passages 630 to 632, and the pilot flow groove 624 make up the aforementioned pilot line 504.

The fixed block 613 has a bore 640 formed therein such that its one end is open to an outer surface of the fixed block, and a spool 641 of the pilot variable throttle valve 505 is slidably disposed in the bore 640. As shown, the bore 640 is formed parallel to the bore 601 for the directional control valve 21 and, correspondingly, the pilot spool 641 is also disposed parallel to the main spool 602.

Near the center of the bore 640, there are formed an annular inlet passage 642 to which the passage 630 is open, an annular outlet passage 643 to which the passage 632 is open, and an annular land portion 644 located between the inlet passage 642 and the outlet passage 643. The inlet passage 642 and the outlet passage 643 also make up part of the aforementioned pilot line. The pilot spool 641 has a sloped portion **641*a* which cooperates with the land portion 644 to form a pilot variable throttle 645 between the inlet passage 642 and the outlet passage 643. The pilot variable throttle 645 has an opening area changed from a predetermined minimum opening to a predetermined maximum opening depending on the amount of movement (i.e., stroke) of the pilot spool 641**.

The open end of the bore 640 is closed by a screw 646 and a spring 647 is disposed between the screw 646 and the pilot spool 641 such that both ends of the spring abut against the pilot spool 641 and the screw 646 to urge the pilot spool 641 in the valve opening direction. The screw 646 is fastened to a threaded hole formed in an open end portion of the bore 640 for giving the spring 647 a preset force.

A pressure bearing chamber serving as the aforementioned pilot control sector **505*a* is formed between the bottom of the bore 640 and the end of the spool 641, while a pressure bearing chamber 651 is formed in a space between the screw 646 and the spool 641 where the spring 647 is disposed. The fixed block 613 further has formed therein passages 800, 801 being open respectively to the pressure bearing chambers 505*a*, 651. The passage 800 is connected to the aforementioned line 71 for introducing the boom-up secondary pressure C to the pressure bearing chamber (pilot control sector) 505*a* so that the hydraulic force produced with the secondary pressure C is applied to the pilot spool 641 in the valve closing direction. The passage 801 is connected to the reservoir 16 through the line 804 to hold the pressure bearing chamber 651** at the reservoir pressure.

With the valve structure constructed as explained above, the flow control valve 90 of seat valve type operates based on the principles described in JP. A. 58-501781. More specifically, the opening area of the auxiliary variable throttle 501 formed on the seat valve body 502 is changed depending on the amount of movement (i.e., stroke) of the seat valve body 502, and the amount of movement of the seat valve body 502 is determined depending on the pilot flow rate passing through the control variable throttle 503. Further, the pilot flow rate is determined by the opening area of the variable throttle 645 of the pilot variable throttle valve 505. As a result, the main flow rate flowing out from the feeder passage 32C to the feeder passage 32D through the auxiliary variable throttle 501 of the seat valve body 502 is in proportion to the pilot flow rate and hence determined by the opening area of the variable throttle 645 of the pilot variable throttle valve 505.

Additionally, in the pilot variable throttle valve 505, the opening area of the variable throttle 645 is controlled so as to be changed depending on the boom-up secondary pressure C.

Thus, in a combination of the pilot line 504 and the pilot variable throttle valve 505, the seat valve 500 controls the flow rate of the hydraulic fluid supplied from the first parallel passage 40 to the main variable throttle 16A or 16B through the feeder passage 32 in such a manner as to restrict that flow rate depending on the boom-up secondary pressure C. This point will be described below in more detail.

Figure 11:
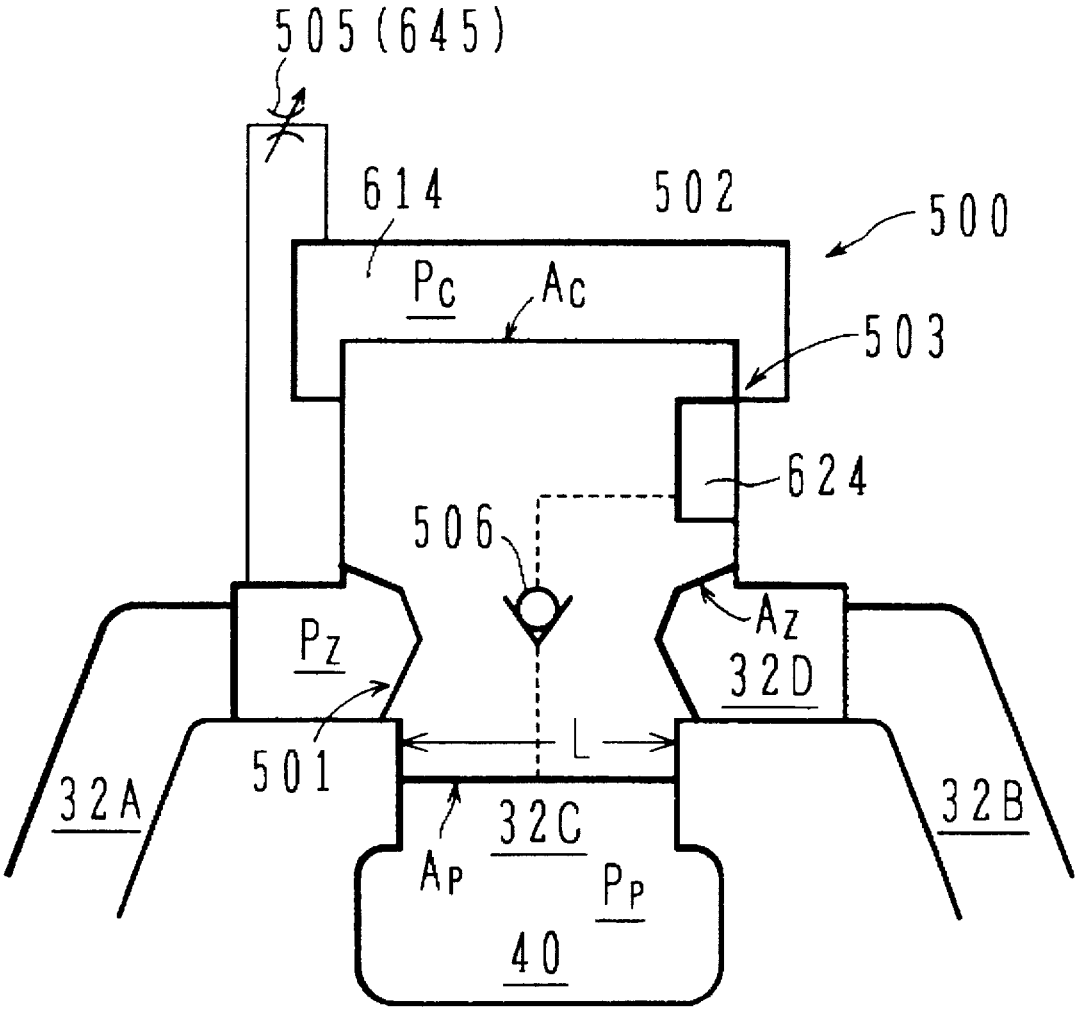
FIG. 11 is an explanatory view for explaining the operation of the flow control valve of seat valve type shown in FIG. 10.

In FIG. 11, assuming that the effective pressure bearing area of the end surface of a portion of the seat valve body 502 which is positioned in the feeder passage 32C is Ap, the effective pressure bearing area of an annular portion of the seat valve body 502 which is positioned in the annular feeder passage 32D is Az, the effective pressure bearing area of the end surface of a portion of the seat valve body 502 which is positioned in the hydraulic chamber 614 is Ac, the pressure in the feeder passage 32C (the supply pressure in the first parallel passage 40) is Pp, the pressure in the feeder passage 32D is Pz, and the pressure in the hydraulic chamber 614 is Pc, a relationship of $$Ac=Az+Ap \tag{1}$$

holds from the balance among the pressure bearing areas Ap, Az, Ac of the seat valve body 502 and a relationship of $$Ap\cdot Pp+Az\cdot Pz=Ac\cdot Pc \tag{2}$$

holds from the balance among the pressures exerted on the seat valve body 502. By substituting Ap/Ac=K in the equation (1), Az/Ac=1−K is obtained and, therefore, $$Pc=K\cdot Pp+(1-K)\cdot Pz \tag{3}$$

is obtained from the equation (2). Assuming now the width of the pilot flow groove 624 to be constant w, the opening area of the control variable throttle 503 for the amount of movement x of the seat valve body 502 is wx. Given the pilot pressure at this time being qs, it is expressed by:

$$qs=C1\cdot wx\cdot(Pp-Pc)^{1/2} \tag{4}$$

where C1: flow rate coefficient of the control variable throttle 503

By substituting the equation (3) in the equation (4), $qs=C1\cdot wx\{(1-K)(Pp-Pz)\}^{1/2}$ is resulted. Accordingly, the amount of movement x is given by:

$$x=(qs/C1\cdot w)/\{(1-K)(Pp-Pz)\}^{1/2} \tag{5}$$

It is seen from the equation (5) that, if the difference between the pressure Pp and the pressure Pz is constant, qs is determined by the amount of movement x.

Further, supposing the opening area of the variable throttle 645 of the pilot variable throttle valve 505 to be a, since the pilot flow rate qs passes through the opening area a, there holds:

$$qs=C2\cdot a\cdot(Pc-Pz)^{1/2} \tag{6}$$

where C2: flow rate coefficient of the variable throttle 645

The equation (6) can be rewritten into:

$$\begin{aligned} qs &= C2\cdot a\cdot\{K\cdot Pp+(1-K)Pz-Pz\}^{1/2} \\ &= C2\cdot a\cdot K^{1/2}\cdot(Pp-Pz)^{1/2} \end{aligned} \tag{7}$$

By substituting the equation (7) in the equation (5), $$\begin{aligned} x &= (C2\cdot a/C1\cdot w)\{K/(1-K)\}^{1/2} \\ &= (C2/C1\cdot w)\{K/(1-K)\}^{1/2}\cdot a \end{aligned} \tag{8}$$

is obtained. As will be seen from the equation (8), the amount of movement x of the seat valve body 502 is controlled by the opening area a of the variable throttle 645 of the pilot variable throttle valve 505 provided in the pilot line.

On the other hand, assuming that the main flow rate flowing out from the feeder passage 32C to the feeder passage 32D through the auxiliary variable throttle 501 of the seat valve 500 is Qs and the outer diameter of a portion of the seat valve body 502 which is positioned in the feeder passage 32 is L, since the opening area of the auxiliary variable throttle 501 is equal to the product of the outer diameter L and the amount of movement x, there holds:

$$Qs=C3\cdot L\cdot x\cdot(Pp-Pz)^{1/2} \tag{9}$$

where C3: flow rate coefficient of the auxiliary variable throttle 501

By substituting the equation (5) in the equation (9), $$Qs=\{(C3\cdot L/C1\cdot w)/(1-K)^{1/2}\}\cdot qs \tag{10}$$

Here, given $\alpha=(C3\cdot L/C1\cdot w)/(1-K)^{1/2}$, $$Qs=\alpha\cdot qs \tag{11}$$

is obtained. It is thus seen that the main flow rate Qs is in proportion to the pilot flow rate qs. Accordingly, the total flow rate Qv passing through the flow control valve 90 is expressed by:

$$Qv=Qs+qs=(1+\alpha)qs \tag{12}$$

Next, in the pilot variable throttle valve 505, the preset force of the spring 647 is imparted as an urging force to the spool 641 in the valve opening direction, and the boom-up secondary pressure C is applied to the pressure bearing chamber **505*a* in the valve closing direction. Therefore, assuming that the pressure-converted value of the preset force of the spring 647 is F, the pressure-converted value of the spring constant of the spring 647 is K, the secondary pressure C is Pi, and the amount of movement of the pilot spool 641 in the valve closing direction is X, the balance among forces exerted on the pilot spool 641** is expressed by:

$$Pi=F+K\cdot X \tag{13}$$

Thus, the amount of movement X of the pilot spool 641 is determined by the secondary pressure Pi and, as the secondary pressure Pi increases, the amount of movement X of the pilot spool 641 is also increased and the opening area of the pilot variable throttle 645 is reduced.

Accordingly, since the amount of movement x of the seat valve body 502 is controlled by the opening area of the pilot variable throttle 645 as described above, the flow rate Qv of the hydraulic fluid flowing from the feeder passage 32C to the feeder passage 32A or 32B can be controlled by the boom-up secondary pressure C and the flow control valve 90 of seat valve type implements the same function as the variable throttle valve 70 shown in FIG. 1.

Even when the load is so increased that the load pressure becomes higher than the supply pressure, causing the hydraulic fluid to be about to flow in the reversed direction, since the pressure in the hydraulic chamber 614 is also increased to move the seat valve body 502 in the valve closing direction for fully closing the auxiliary variable throttle 501 and the load check valve 506 is installed in the passage 622, the hydraulic fluid is prevented from flowing reversely from the feeder passage 32A or 32B to the feeder passage 32C and the seat valve 500 also implements the function of the load check valve **32*a* shown in FIG. 1**.

With this embodiment, as explained above, the flow control valve 90 of seat valve type implements the same function as the variable throttle valve 70 shown in FIG. 1. Therefore, in the case of driving the boom, the arm and the bucket simultaneously as the triple combined operation of boom-up, arm-crowd and bucket-crowd in the air, it is possible to restrict the flow rate of the hydraulic fluid supplied through the bucket directional control valve 21 depending on the boom-up secondary pressure C and raise the pressure in the first parallel passage 40 so as to be not less than the load pressure of the boom 300. Consequently, the hydraulic fluid from the first hydraulic pump 10 can be supplied to the boom cylinder 50 which undergoes a higher load pressure than the bucket cylinder 54 holding the bucket 302 which is now going to drop by its own weight, enabling the boom to be raised easily.

Also, since the pilot changeover valve 81B is installed in the line 71, the boom-up secondary pressure C is introduced to the pilot control sector **70*a* of the variable throttle valve 70 only when the arm-crowd secondary pressure F exceeds the pressure F0 at or above which the hydraulic fluid from the second hydraulic pump 11 flows to the arm cylinder 52** at the full flow rate, as with the second embodiment. Therefore, this embodiment can also provide the advantage of improving operability and economic efficiency in the double combined operation of boom-up and bucket-crowd and in the triple combined operation of boom-up, arm-crowd and bucket-crowd.

Further, according to this embodiment, in the flow control valve 90 of seat valve type, the seat valve body 502 of the seat valve 500 has the structural arrangement similar to that of a load check valve disposed in a feeder passage in the conventional valve structure, and the pilot variable throttle valve 505 can be arranged by utilizing the fixed block 613 which is separate from the housing 600 and serves to hold the seat valve body 502. Therefore, the auxiliary flow control means can be achieved with desired performance without modifying the structure of a conventional directional control valve to a large extent.

Additionally, since the flow control valve 90 of seat valve type implements the two functions of the variable throttle valve 70 and the load check valve **32*a* shown in FIG. 1, and only one seat valve 500 is disposed in the feeder passage 32 as the main circuit, the entire valve structure becomes simpler and compacter than in the case of arranging two valves, i.e., the load check valve 32*a* and the variable throttle valve 70, in the feeder passage 32 like the embodiment shown in FIG. 1**, and the pressure loss caused upon the hydraulic fluid passing through the main circuit is reduced so that the actuator may be operated with small energy loss.

While the check valve 506 is incorporated in the seat valve body 52 in the third embodiment, the load check function in the pilot line can be achieved even if the check valve 506 is not provided, by modifying the arrangement such that when the seat valve body 502 is in the fully closed position, the control variable throttle 503 formed in the pilot flow groove 624 is also fully closed. In this case, however, because the control variable throttle 503 is not opened at once when the seat valve body 502 moves from the fully closed position in the valve opening direction, the pilot flow may possibly be unstable immediately after the opening of the seat valve body 502. By contrast, with the arrangement of this embodiment that the control variable throttle 503 is not completely closed when the seat valve body 502 is moved to the fully closed position, the pilot flow can stably be produced, the flow control accuracy is improved, and manufacture of the control variable throttle 503 is facilitated.

Moreover, while the check valve 122 is disposed in the seat valve body 502 in this embodiment, the check valve may be located anywhere along the pilot line. For example, the check valve may be disposed between the fixed block 613 and the housing 600 at the junction of the passage 631 and the passages 632.

INDUSTRIAL APPLICABILITY

According to the present invention, even when the triple combined operation of boom-up, arm-crowd and bucket-crowd is carried out in the air, the boom can be raised, allowing the operator to manipulate the boom as per the intention, and an abrupt motion of the boom which may occur beyond the operator's expectation, for example, when the bucket cylinder is moved to its stroke end, can be avoided so as to ensure safety during the work.

We claim:

1. A hydraulic circuit system mounted on a hydraulic excavator having at least three kinds of working elements of a boom (300), an arm (301) and a bucket (302), and comprising a plurality of actuators including a boom cylinder (50) for driving said boom, an arm cylinder (52) for driving said arm and a bucket cylinder (54) for driving said bucket, said hydraulic circuit system further comprising at least two first and second hydraulic pumps (10, 11), and a hydraulic valve apparatus (12) for supplying hydraulic fluids from said first and second hydraulic pumps to at least said boom cylinder, said arm cylinder and said bucket cylinder therethrough, said hydraulic valve apparatus comprising a first boom directional control valve (22) for controlling a flow of the hydraulic fluid supplied from the first hydraulic pump (10) to said boom cylinder (50), a bucket directional control valve (21) for controlling a flow of the hydraulic fluid supplied from said first hydraulic pump to said bucket cylinder (54), a second boom directional control valve (26) for controlling a flow of the hydraulic fluid supplied from said second hydraulic pump to said boom cylinder (50), and an arm directional control valve (25) for controlling a flow of the hydraulic fluid supplied from said second hydraulic pump to said arm cylinder (52), said first boom directional control valve (22) and said bucket directional control valve (21) having feeder passages (33, 32) connected to said first hydraulic pump so that the hydraulic fluid from said first hydraulic pump is supplied in parallel to said first boom directional control valve and said bucket directional control valve, said second boom directional control valve (26) and said arm directional control valve (25) having feeder passages (37, 36*a*) connected to said second hydraulic pump so that the hydraulic fluid from said second hydraulic pump is supplied in parallel to said second boom directional control valve and said arm directional control valve, wherein said hydraulic circuit system for the hydraulic excavator further comprises:

boom-up detecting means (71) for detecting the boom-up operation of moving said boom (300) upwardly, and auxiliary flow control means (70; 90) disposed in the feeder passage (32) of said bucket directional control valve (21) for restricting the flow rate of the hydraulic fluid supplied through said bucket directional control valve when the boom-up operation is detected by said boom-up detecting means.

2. A hydraulic circuit system for a hydraulic excavator according to claim 1, wherein said boom-up detecting means (71) is means for detecting an input amount to said first boom directional control valve (22), and said auxiliary flow control means includes variable flow control means (70; 90) having an opening area reduced depending on the detected input amount.

3. A hydraulic circuit system for a hydraulic excavator according to claim 1, wherein said directional control valves (22, 21, 26, 25) are pilot-operated valves shifted with hydraulic signals, and said boom-up detecting means is line means (71) for introducing a boom-up hydraulic signal to said auxiliary flow control means (70; 90) therethrough.

4. A hydraulic circuit system for a hydraulic excavator according to claim 1, further comprising arm-crowd detecting means (82) for detecting the arm-crowd operation of crowding said arm inwardly, and changeover means (81) permitting, only when the arm-crowd operation is detected by said arm-crowd detecting means, restriction of the supplied flow rate that is to be effected by said auxiliary flow control means (70; 90) when the boom-up operation is detected by said boom-up detecting means (71).

5. A hydraulic circuit system for a hydraulic excavator according to claim 4, wherein said arm-crowd detecting means is means (82) for detecting an input amount to said arm directional control valve (25), and said changeover means (81) operates to permit, only when the input amount to said arm directional control valve (25) exceeds a predetermined value, restriction of the supplied flow rate that is to be effected by said auxiliary flow control means (70; 90) when the boom-up operation is detected by said boom-up detecting means (71).

6. A hydraulic circuit system for a hydraulic excavator according to claim 4, wherein said directional control valves (22, 21, 26, 25) are pilot-operated valves shifted with hydraulic signals, said boom-up detecting means is first line means (71) for introducing a boom-up hydraulic signal to said auxiliary flow control means (70; 90) therethrough, said arm-crowd detecting means is second line means (82) for introducing an arm-crowd hydraulic signal to said changeover means (81) therethrough, and said changeover means is a changeover valve (81) disposed in said first line means (71) and operated with the arm-crowd hydraulic signal through said second line means (82).

7. A hydraulic circuit system for a hydraulic excavator according to claim 1, wherein said auxiliary flow control means (90) comprises:

(a) a seat valve (500) disposed in said feeder passage (32), said seat valve (500) including a seat valve body (502) forming an auxiliary variable throttle (501) in said feeder passage, and a control variable throttle (503) formed in said seat valve body and having an opening area changed depending on the amount of movement of said seat valve body;

(b) a pilot line (504) for communicating part of said feeder passage (32) upstream of said auxiliary variable throttle (501) with the downstream side of said feeder passage through said control variable throttle (503) and determining the amount of movement of said seat valve body (502) in accordance with the flow rate of the hydraulic fluid flowing therethrough; and (c) pilot flow control means including a pilot variable throttle (505) disposed in said pilot line (504) and changing an opening area of said pilot variable throttle in accordance with a signal from said boom-up detecting means (71), thereby controlling the flow rate of the hydraulic fluid flowing through said pilot line.

8. A hydraulic circuit system for a hydraulic excavator according to claim 7, wherein said auxiliary flow control means further comprises a check valve (506) disposed in said pilot line (504) to prevent the hydraulic fluid from flowing in the reversed direction.

9. A hydraulic circuit system for a hydraulic excavator according to claim 2, wherein said directional control valves (22, 21, 26, 25) are pilot-operated valves shifted with hydraulic signals, and said boom-up detecting means is line means (71) for introducing a boom-up hydraulic signal to said auxiliary flow control means (70; 90) therethrough.

10. A hydraulic circuit system for a hydraulic excavator according to claim 2, further comprising arm-crowd detecting means (8) for detecting the arm-crowd operation of crowding said arm inwardly, and changeover means (81) permitting, only when the arm-crowd operation is detected by said arm-crowd detecting means, restriction of the supplied flow rate that is to be effected by said auxiliary flow control means (70; 90) when the boom-up operation is detected by said boom-up detecting means (71).

* * * * *